US007835540B2

(12) United States Patent
Philippe et al.

(10) Patent No.: US 7,835,540 B2
(45) Date of Patent: Nov. 16, 2010

(54) METHOD OF DETECTING BUNCHED-TOGETHER POSTER ITEMS BY ANALYZING IMAGES OF THEIR EDGES

(75) Inventors: Agnès Philippe, Nogent sur Marne (FR); Hicham El Bernoussi, Paris (FR); Claude Mitte, Montigny les Cormeilles (FR)

(73) Assignee: Solystic, Gentilly Cedex (FR)

( * ) Notice: Subject to any disclaimer, the term of this patent is extended or adjusted under 35 U.S.C. 154(b) by 1085 days.

(21) Appl. No.: 11/527,566

(22) Filed: Sep. 27, 2006

(65) Prior Publication Data

US 2007/0071284 A1 Mar. 29, 2007

(30) Foreign Application Priority Data

Sep. 28, 2005 (FR) ..... 05 52919

(51) Int. Cl.
*G06K 9/00* (2006.01)

(52) U.S. Cl. ..... 382/101; 382/100; 382/102; 382/199; 382/224; 209/583; 209/900; 271/258.01

(58) Field of Classification Search ..... 382/100, 382/101, 102, 199, 224; 209/583, 900, 552; 271/264, 258.01, 125
See application file for complete search history.

(56) References Cited

U.S. PATENT DOCUMENTS 6,761,352 B2 * 7/2004 Scicluna et al. ..... 271/153
6,817,610 B2 * 11/2004 Rompe ..... 271/265.04
7,446,278 B2 * 11/2008 Fesquet et al. ..... 209/584

FOREIGN PATENT DOCUMENTS

FR 2 841 487 1/2004
WO WO 03/047773 A2 6/2003

* cited by examiner

*Primary Examiner*—Samir A. Ahmed
*Assistant Examiner*—Ali Bayat
(74) *Attorney, Agent, or Firm*—Sughrue Mion, PLLC

(57) ABSTRACT

A method of detecting bunched-together overlapping postal items includes the steps of moving the postal items on edge above a camera, forming grayscale images including the bottom sides of the postal items, and analyzing the image for the purpose of detecting the presence of any overlapping postal items. The method further includes the steps of transforming each grayscale image into a binary image that causes a boundary defined by a "pale" zone to appear that represents the bottom side of at least one postal item and that extends between two "dark" zones, the boundary having a "right" first profile and a "left" second profile, and the method further includes the step of analyzing the right and left profiles for the purpose of detecting any profile discontinuity that is indicative of the presence of overlapping postal items.

11 Claims, 2 Drawing Sheets

METHOD OF DETECTING BUNCHED-TOGETHER POSTER ITEMS BY ANALYZING IMAGES OF THEIR EDGES

The present invention relates to the field of handling postal items in a postal sorting machine, and more particularly to a method of detecting overlapping or "bunched-together" postal items.

The method of the invention is applicable to small-format postal items such as letters, or to large (very large) format postal items such as magazines.

BACKGROUND OF THE INVENTION

It is known that while postal items are being automatically unstacked in a postal sorting machine, it can happen that two or more postal items can be unstacked together (i.e. bunched together in bunches of two or more), which means that they are conveyed in mutually overlapping manner. Overlapping bunched-together postal items cannot be automatically sorted correctly.

Known methods exist for detecting bunched-together postal items.

A first such method consists in mechanically rubbing both faces of a current postal item upstream from the unstacking in order to separate any other postal item overlapping the current item face-on-face.

A second method consists, at a plurality of measurement points along the path of the postal items, in measuring certain physical magnitudes of the postal items such as length, thickness, and height, in order to detect the presence of bunched-together postal items.

A third method consists in detecting the presence of bunched-together postal items by means of image analysis. In that third method, it is possible to form the image of a postal item seen from the front (that image generally being delivered by means of the optical reader for reading addresses), and the presence of any bunched-together postal items is detected by analyzing the top outline of the postal item, as described in Document FR 2 841 487.

It is also possible, using that third method, to form an image of the bottom edge of the postal item by means of a camera placed under the path of the postal item. Patent Document WO-03047773 describes another method of detecting bunched-together postal items. In that method, the postal items are conveyed, after unstacking, in series and on edge, and a camera is placed under the conveyor so as to form an image of the bottom side (bottom edge) of each postal item passing above the camera. The camera is a scanning linear array charge coupled device (CCD) camera (scanning transversely to the direction of movement of the postal item and thus transversely to the bottom edge (side) of the postal item). The image is a grayscale (GS) image. In that known method, the digital image is scanned row-by-row in the scanning direction (direction perpendicular to the direction of movement of the postal item) in order to measure the grayscale values on each row, and if, over all of the rows, it is detected that two or more maxima are spaced apart on each row and are repeated in a pre-recorded pattern over a set of rows in the image, it is deduced that bunched-together postal items are present.

The first method of detecting bunched-together postal items suffers from the drawback of generating large costs for being integrated into a postal sorting machine. In addition, the postal items can be damaged by the rubbing exerted on them.

The second method of detecting bunched-together postal items suffers from the drawback of not being adapted to a broad range of different postal items.

Analyzing outline using the third method can be unsatisfactory for detecting bunched-together postal item situations in which, when viewed from the front, one item is completely hidden by another postal item that is of larger size.

OBJECTS AND SUMMARY OF THE INVENTION

An object of the invention is to propose a method of detecting bunched-together postal items that is based on analyzing an image of the bottom side of a postal item, but that is improved in that it is adapted to detect bunched-together situations over a broad range of different postal items including very thin postal items (e.g. reply card type postal items having thicknesses of about 0.15 millimeters (mm)) for which the difference between two maxima on a scan row can be very small and undetectable by the method known from Document WO-03047773. It has been observed that, over a batch of postal items, 80% of the bunched-together situations involve thin letters, between which it is difficult to detect any separation. In addition, an object of the invention is to propose a detection method that is robust and that is independent of pre-recorded patterns.

To this end, the invention provides a method of detecting bunched-together overlapping postal items, which method consists in moving the postal items on edge above a camera, and in forming grayscale images of the bottom sides of the postal items for the purpose of detecting the presence of any overlapping postal items by means of image analysis, said method further consisting in transforming each grayscale image into a binary image that causes a boundary defined by a "pale" zone to appear that represents the bottom side of at least one postal item and that extends between two "dark" zones, said boundary having a "right" first profile and a "left" second profile, and further consisting in analyzing the right and left profiles for the purpose of detecting any profile discontinuity that is indicative of the presence of overlapping postal items. In practice, as indicated above, the pale zone represents the bottom side or edge of a postal item, but it should be understood that the method of the invention extends to a pale zone/dark zone inversion when it is the dark zone that represents the edge of a postal item.

The method of the invention may also have the following features:

discontinuity in the profile is detected on the basis of a binary image obtained by thresholding the pixels of the grayscale image formed by the camera;

the analysis of the profile of said boundary is preceded by a search in the image for at least one double pale zone dark zone alternation;

a search is made for a double pale zone dark zone alternation in a binary image obtained by thresholding the pixels of the grayscale image formed by the camera;

a search is made for a double pale zone dark zone alternation in a binary image obtained by thresholding the pixels of a filtered image resulting from high-pass filtering of the grayscale image formed by the camera;

the filtering is filtering of the gradient type;

the filtering of the gradient type is modified with the pixels of the grayscale image;

the grayscale image formed by the camera is subdivided into strips, and a search is made for a double pale zone dark zone alternation in each strip of said image;

a plurality of different processes are performed in parallel so as to search for a double pale zone dark zone alternation in an image, and the results obtained by said processes are combined for the purpose of detecting the presence of bunched-together postal items;

the right and left profiles of the boundary are used to determine data indicative of the thickness of the postal item; and the right and left profiles of the boundary are used for the purpose of determining data indicative of the postal item being in an open state, in a closed state, or in a damaged state.

BRIEF DESCRIPTION OF THE DRAWINGS

The method of the invention is described in more detail below with reference to the drawings, in which.

MORE DETAILED DESCRIPTION

Figure 1:
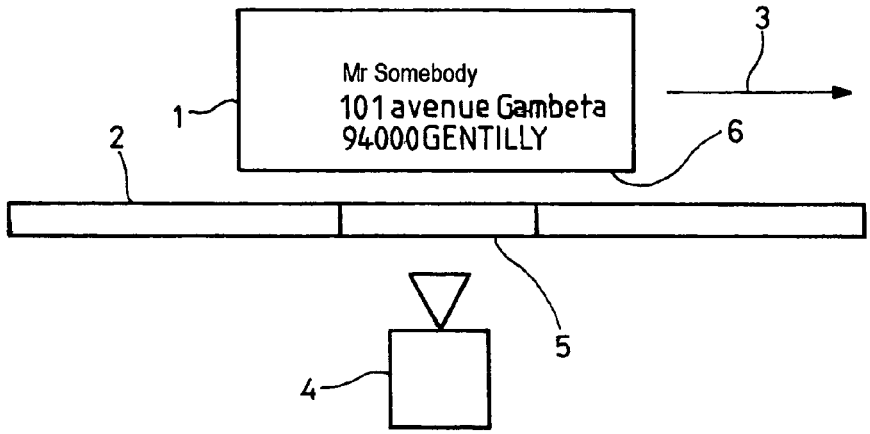
FIG. 1 is a very diagrammatic view showing the principle of forming an image of the bottom side of a postal item moving on edge.

FIG. 1 shows a postal item 1 (seen from the front) which is being moved on edge by a conveyor 2 (e.g. a conveyor having two bands between which the postal item is nipped) in a conveying direction indicated by arrow 3. For example, the conveyor 2 is placed between an unstacker and the sorting outlets of a postal sorting machine that is conventional per se and that is not shown in the drawings.

As shown in FIG. 1, a linear-array CCD camera 4 is disposed under the conveyor 2 so as to form a grayscale digital image of the bottom side 6 of the postal item 1 on edge, which image is formed through a dust shield 5.

Preferably, a high-resolution camera 4 is used, e.g. a camera having a resolution of 20 pixels per millimeter, making it possible to identify a separation of about 0.10 mm between two overlapping postal items. In addition, a system for illuminating the underside of the postal item is used that is made up of two laser diodes provided with a generator for generating a line at 22°, e.g. having a wavelength of 650 nanometers (nm) and a power of 5 milliwatts (mW). Said laser diodes (not shown) are positioned under the conveyor so as to direct converging light beams with an angle of incidence that is very small (of the order of 25°) thereby avoiding any illumination shadow due to one postal item being disposed lower than another postal item. Said laser diodes form a rectangular illumination plane having a length of about 40 mm in the horizontal direction that is perpendicular to the direction 3 over a width of 3 mm in the direction 3. For mail of large or very large format, the length of the illumination plane can be set to about 50 mm.

The camera 4 is preferably a CCD linear array of 512 points equipped with an F1.6/25 mm lens that is adjustable for small-format and large or very large format mail.

The entire optical system has a resolution of about 20 points/mm in the horizontal direction perpendicular to the direction 3, and a resolution that lies in the range 3 points/mm to 8 points/mm in said direction 3 for small-format mail and that varies as a function of the speed of conveying. For large-format mail, the resolution can be respectively 15 points/mm and lie in the range 3 points/mm to 6 points/mm. This high resolution contributes to making the method of the invention effective.

The image is taken in response to a signal delivered by a pass sensor disposed along the conveyor as is well known and the images are processed in real time.

However, the sensitivity of the CCD sensor gives rise to noise in the GS image and thus requires appropriate processing, as described in detail below, for detecting bunched-together postal items.

Figure 2:
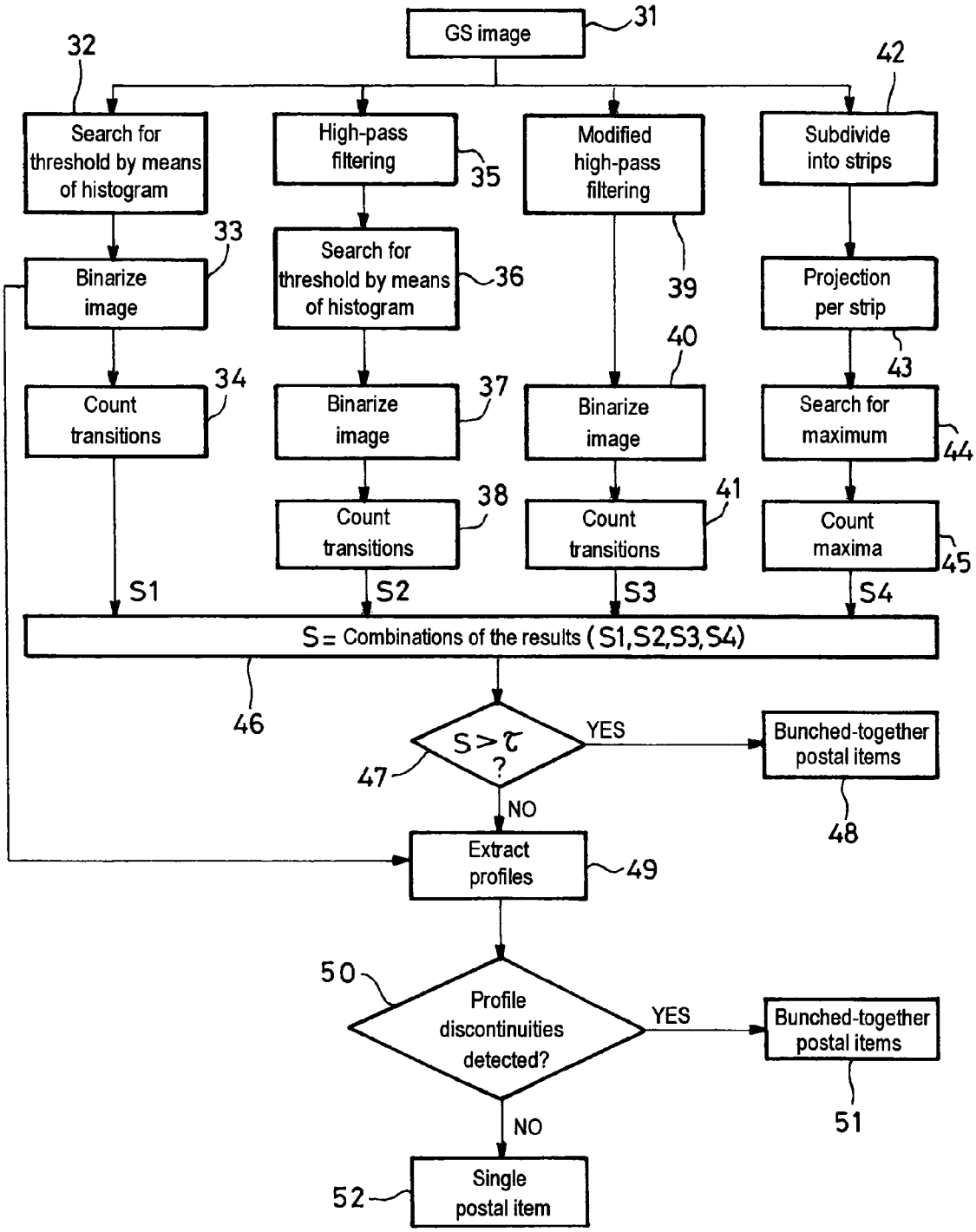
FIG. 2 is a flow chart showing the various steps of the method of the invention.

In the method of the invention, whose main steps are shown in FIG. 2, the first step (step 31) consists in forming a high-resolution GS image of the bottom side of a postal item detected by the sensor (e.g. an image having a size of 240 pixels by 800 pixels). On the basis of the image, two-stage processing is performed.

The first processing stage consists in running a set of processes in parallel in order to use overall or local approaches to detect the presence of a dark zone between two pale zones characterizing the presence of two or more bunched-together postal items.

A first process consists in automatically searching (in step 32) for a threshold adapted to binarize the GS image on the basis of the histogram of the GS image. Threshold binarizing constitutes an overall approach to GS image processing, and such an overall approach is well adapted to noisy images. For example, conventionally a search is made for a valley between two maxima in the histogram in order to determine the value of the threshold. In step 33, the GS image is binarized in order to obtain a binary image (shown in FIG. 3) in which two distinct types of zone appear: dark zones DZs and pale zones PZs, a pale zone PZ defining the bottom side of at least one postal item 1, and a dark zone DZ defining the empty space around said side of the postal item. In general manner, in the field of image processing, the pixels of a dark zone DZ of the binary image are black and the pixels of a pale zone PZ of the binary image are white.

Figure 3:
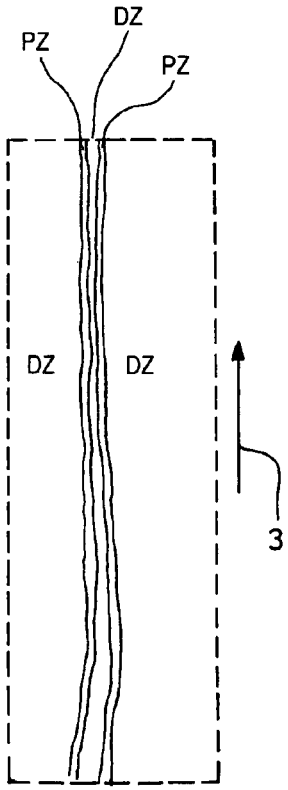
FIG. 3 shows a binary image obtained by the method of the invention.

FIG. 3 shows the binary image obtained in step 33, defined by dashed lines, and showing the bottom sides of two postal items 1 extending in the conveying direction 3. The two overlapping postal items 1 are bunched-together in a two-item bunch and they are separated by a space that is visible by means of the high resolution and, in the remainder of the method, endeavors are made to detect said space.

After step 33, at 34, the binary image is analyzed pixel row by pixel row (the rows of pixels of the binary image extending perpendicularly to the conveying direction 3). Below, let i be a pixel row index and j be a pixel column index. Each row is scanned so as to count the number of transitions from a dark zone DZ to a pale zone PZ, such transitions being referred to as "DZ-PZ transitions". Then, computing is performed representing the mean number of DZ-PZ transitions per row for the binary image so as to obtain a result S1 that can be defined on the basis of the following relationship:

$$S1 = \frac{\sum_{rows} \text{number of transitions per row}}{\text{total number of rows}} - 1$$

It can be deduced that two bunched-together postal items are present if S1 is close to 1. If S1 is close to 0, it can be deduced that a single (non-bunched) postal item is present.

For a non-bunched single-item situation made up of a dark zone, of a pale zone, and of a dark zone in alternation (DZ-PZ-DZ), only one DZ-PZ transition is counted while a row is being scanned. Similarly, for a two-item bunched-together situation characterized by DZ-PZ-DZ-PZ-DZ in alternation, only two DZ-PZ transitions are counted. Therefore, the double alternation DZ-PZ-DZ-PZ is the minimum condition for detecting two postal items bunched together with a space between the items.

In a particular implementation of the invention, the presence of bunched-together postal items is detected only on the basis of the result S, which offers the advantage of being fast and well adapted to processing postal items in real time.

The second process consists in filtering (step 35) the GS image formed in step 31 by a high-pass filter, which constitutes a local approach to processing the GS image. For example, a gradient filter angularly positioned perpendicularly to the conveying direction 3 is used as a high-pass filter for obtaining a filtered image in which the value of each pixel F(i, j) is defined as follows:

$$F(i, j)=\mathrm{Max}(GS(i, j+1)-GS(i, j); 0)$$

where GS(i, j) is the grayscale value of the pixel of co-ordinates (i, j) in the GS image. As is known, filtering by gradient filter accentuates the transitions between the highly contrasted zones. After filtering, only the dark-to-pale transitions are preserved since the pale-to-dark transitions give negative values and are thus removed by the operator Max. Such filtering offers the advantage of making it possible to detect thin postal items that are bunched together.

The filtering step 35 is followed by a step 36 of searching for a threshold on the basis of the histogram of the filtered image, by a step 37 of binarizing the filtered image on the basis of the threshold obtained in step 36, and by a step 38 of computing the mean number of transitions per row in order to obtain a result S2. The processing performed in steps 36 to 38 of the second process is identical to the processing in steps 32 to 34 of the first process. However, in the second process, steps 36 to 38 are applied to the filtered image obtained in step 35. Therefore, the second process combines local and overall approaches.

In the third process, the GS image is filtered by a linear combination of the gradient and of the GS image in order to be less sensitive to noise, thereby smoothing the image. In step 39, the GS image is filtered so as to obtain a filtered image in which the value of each pixel F'(i, j) is defined as follows:

$$F'(i, j)=\mathrm{Max}(\alpha*F(i, j)+\beta*GS(i, j; 0)$$

Experimentation has shown that good results are obtained for a $\alpha=2$ and $\beta=3$. In step 40, the image filtered in step 39 is binarized by means of a pre-established threshold. In step 41, the mean number S3 of transitions per row is computed in the binary image as described above for S1 and S2.

The fourth process consists in subdividing (step 42) the GS image in a direction perpendicular to the conveying direction 3 so as to obtain GS image strips of fixed size equal to eight rows, for example. In step 43, for each strip, a projection is made in the conveying direction 3, i.e. the mean of the grayscale levels of the pixels is computed per GS image column so that the rows of a strip are all the same after projection. With projection processing, the GS image is smoothed, thereby making the method of detecting bunched-together postal items less sensitive to noise.

In step 44, in one row of each strip (all of the rows in a strip are identical), a search is made for the number of maxima in terms of grayscale levels. As is known, searching for maxima can firstly consist in searching for local maxima and minima, and then, if the local maxima or minima are not very different or too similar then they are rejected, until a minimum is found that is situated between two maxima for detecting two bunched-together postal items. In step 45, computation is performed that is representative of the mean number S4 of maxima for the GS image using the following relationship:

$$S4=\frac{\sum_{strip}\text{number of maxima per strip}}{\text{total number of strips}}-1$$

It can be understood that, for a value of S4 close to 0, it is deduced that a single non-bunched postal item is present, and that for a value of S4 close to 1, it is deduced that two bunched-together postal items are present.

In the method of the invention, the results S1, S2, S3, and S4 are combined in step 46, e.g. by taking the mean of the results S1, S2, S3, and S4 so as to obtain a final result S. Other types of combination are possible without going beyond the ambit of the invention: linear, maximum, minimum, or fuzzy integral combination. The choice of the aggregation operator makes it possible to harden the decision regarding bunched-together item detection to a greater or lesser extent. The operators can be generalized by more complex operators such as a knowledge-base expert system or a neural network. Said combination of the results S1 to S4 contributes to improving the rate of detection of bunched-together postal items and reduces incorrect detection.

In step 47, the final result S is compared with a predefined threshold $\tau$, e.g. equal to 0.15. If the final result S is greater than the threshold, it is deduced that bunched-together postal items are present in step 48. If the final result S is less than the threshold, the method of the invention continues with the second stage of the processing that starts in step 49. The threshold $\tau$ is chosen so as to obtain a good compromise between sorting to incorrect directions, and postal items being detected incorrectly as being bunched together.

The second stage of the processing is normally activated after the transition detection first stage, but it should be understood that said second stage can be implemented separately from the first stage.

In step 49 the binary image obtained on the basis of the histogram in step 33 is retrieved, and the profiles of a boundary extending between two dark zones DZs are extracted from said binary image as described below.

The following relationship defines, for example, the left profile Pl(i) of the pale zone PZ of the boundary:

$$Pl(i)=\mathrm{Min}\{j/I\mathrm{bin}(i, j)=\mathrm{va}\mathbf{1}PZ\}$$

where i designates the row position index, j designates the column position index, Ibin (i, j) designates the value of the pixel of co-ordinates (i, j) in the binary image obtained in step 33, and valPZ indicates the value of a pixel of a pale zone PZ. It can be understood that the left profile of the postal item is defined as being the first pixel of a pale zone PZ when each row of the binary image Ibin is scanned from left to right.

Figure 4:
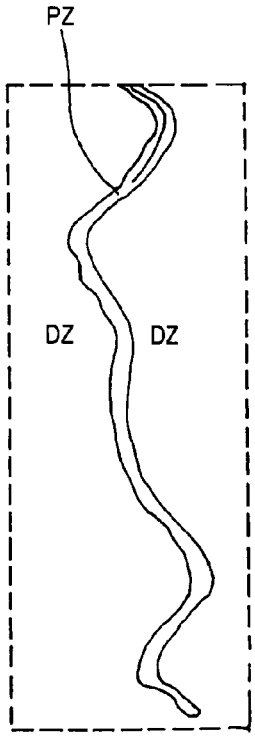
FIG. 4 shows a binary image obtained by the method of the invention.
Figure 5:
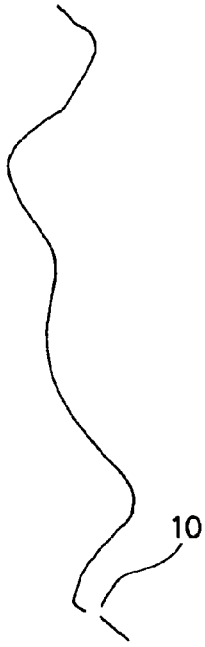
FIG. 5 shows the left profile of the pale zone in the FIG. 4 image.

FIG. 4 shows an example of a binary image obtained in step 34 and for which the four preceding methods do not make it possible to detect a space between two pale zones PZs. The left profile of the binary image shown in FIG. 4 is shown in FIG. 5.

Figure 6:
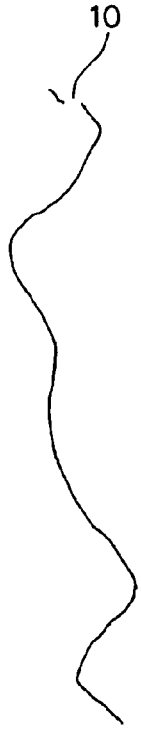
FIG. 6 shows the right profile of the pale zone in the FIG. 4 image.

The following relationship defines the right profile Pd(i) of a pale zone PZ of the boundary:

$$Pr(i)=\mathrm{Max}\{(j/I\mathrm{bin}(i, j)=\mathrm{va}\mathbf{1}PZ\}$$

where i designates the row index, l designates the column index, Ibin (i,j) designates the grayscale level value of the pixel of co-ordinates (i, j) in the binary image obtained in step 33, and valPZ indicates the value of a pixel in a pale zone PZ. It can be understood that the right profile of the postal item is defined as being the last pixel of a pale zone PZ when each row of the binary image Ibin is scanned from left to right. The right profile of the example is shown in FIG. 6.

In step 50, the discontinuities of each of the left and right profiles are detected by means of following finite difference: |Pl(i+1)−Pl(i)| for the left profile; and by means of the finite difference |Pr(i+1)−Pr(i)| for the right profile. When a discontinuity is identified that is greater than a threshold value for one of the profiles then it is deduced therefrom that bunched-together postal items are present in step 51. Otherwise, it is deduced that a single non-bunched postal item is present in step 52. By way of example, with a resolution of 20 pixels per mm (case of small-format letters), the threshold value for detecting a discontinuity can be set at 3 pixels.

It should be understood that the description of the above implementation is in no way limiting on the invention. In particular, the boundary extending between two dark zones DZs can be defined by a pale zone that is not continuous. Similarly, the steps 49 to 52 of the method can be applied to overlapping postal items which are separated by a space.

The process constituted by steps 49 to 52 imparts improved robustness to a method of detecting bunched-together postal items by analyzing images of the postal items seen from underneath.

The combination of the two detection phases makes it possible to adapt to various postal item situations, such as situations with postal items that are curved, damaged, or open.

In addition, the detection method of the invention can be continued with measurement of the thickness of each postal item detected as being a single non-bunched postal item at 52.

In particular, on the basis of the right and left profiles obtained in step 49, it is possible to define a thickness value Tp(i) for the row position index i by means of the following relationship:

$$Tp(i)=Pr(i)-Pl(i)$$

Tp(i) thus indicates the thickness of the postal item at each point along the bottom side of the postal item. A maximum thickness, a minimum thickness, a mean thickness, and a standard deviation over the thickness can thus be computed for a postal item.

Additional processing can also be performed after step 52 for the purpose of analyzing the state of the postal item by means of two complementary measurements. In the first measurement, the aim is to evaluate the regularity of the right and left profiles indicated above. To this end, a polygonal approximation of each of the profiles is performed, said approximation being designated below by "PAl" for the left profile and "PAr" for the right profile. As is well known, a polygonal approximation consists in approximating the left and right profiles by means of straight line segments. The first measurement Ir1 can be defined by the following relationship:

$$Ir1 = \sum_i (|P\lambda(i) - PA\lambda(i)| + |Pr(i) - PA\lambda(i)|)$$

It can be understood that the measurement Ir1 compares a profile and its polygonal approximation in order to evaluate the regularity of the profile. The larger Ir1, the more irregular the profile.

The second measurement serves to determine whether a postal item is damaged. It consists in measuring, in the binary image, the proportion of related components of dark zones DZs that are included in pale zones PZs. The second measurement Ir2 can be defined by the following relationship:

$$Ir2 = \frac{\text{Area}(PZ) - \text{Area}(DZ \text{ included in } PZ)}{\text{Area}(PZ)}$$

On the basis of a mean of Ir1 and Ir2, a value is obtained that is representative of the morphological state of a postal item, thereby making it possible to determine whether the postal item is damaged, or open, for example, and thus, as appropriate, to direct it to automatic sorting or to manual sorting. In addition, the information on the morphological state of the postal items makes it possible to control the setting of the postal item unstacker at the inlet of the sorting machine.

What is claimed is:

1. A method of detecting bunched-together overlapping postal items, which method comprises moving the postal items on edge above a camera, and forming grayscale images of the bottom sides of the postal items for the purpose of detecting the presence of any overlapping postal items by means of image analysis, said method further comprising transforming each grayscale image into a binary image that causes a boundary defined by a "pale" zone to appear that represents the bottom side of at least one postal item and that extends between two "dark" zones, said boundary having a "right" first profile and a "left" second profile, and further comprising analyzing the right and left profiles for the purpose of detecting any profile discontinuity that is indicative of the presence of overlapping postal items.

2. A method according to claim 1, in which discontinuity in the profile is detected on the basis of a binary image obtained by thresholding of the pixels of the grayscale image.

3. A method according to claim 1, in which the analysis of the profile of said boundary is preceded by a search in the image for at least one double pale zone dark zone alternation.

4. A method according to claim 3, in which a search is made for a double pale zone dark zone alternation in a binary image obtained by thresholding of the pixels of the grayscale image.

5. A method according to claim 4, in which a plurality of different processes are performed in parallel so as to search for a double pale zone dark zone alternation in an image of the postal item, and the results obtained by said processes are combined for the purpose of detecting the presence of bunched-together postal items.

6. A method according to claim 3, in which a search is made for a double pale zone dark zone alternation in a binary image obtained by thresholding of the pixels of a filtered image resulting from high-pass filtering of the grayscale image.

7. A method according to claim 6, in which the filtering is filtering of the gradient type.

8. A method according to claim 7, in which the filtering of the gradient type is modified with the pixels of the grayscale image.

9. A method according to claim 3, in which the grayscale image is subdivided into strips, for each strip the pixels are averaged, and a search is made for a double pale zone dark zone alternation in each strip of said image.

10. A method according to claim 1, in which the right and left profiles of the boundary are used to determine data indicative of the thickness of the postal item.

11. A method according to claim 1, in which the right and left profiles of the boundary are used, and a measurement is taken of the proportion of related components of dark zones included in pale zones in the binary image for the purpose of determining data indicative of the postal item being in an open state, in a closed state, or in a damaged state.

* * * * *